United States Patent [19]

Vignon et al.

[11] Patent Number: 4,480,355

[45] Date of Patent: Nov. 6, 1984

[54] DRAWING FRAME

[75] Inventors: Louis Vignon, Geneva; Alf Schopper, Meyrin, both of Switzerland

[73] Assignee: Heberlein Hispano SA, Vernier-Geneva, Switzerland

[21] Appl. No.: 409,289

[22] Filed: Aug. 18, 1982

[30] Foreign Application Priority Data

Aug. 24, 1981 [DE] Fed. Rep. of Germany ..... 3133436
Aug. 24, 1981 [DE] Fed. Rep. of Germany ..... 3133437

[51] Int. Cl.[3] ..... D01H 5/32

[52] U.S. Cl. ..... 19/236; 19/258; 19/293

[58] Field of Search ..... 19/236, 258, 293

[56] References Cited

U.S. PATENT DOCUMENTS 3,869,759 3/1975 Savageau et al. ..... 19/293

*Primary Examiner*—Louis Rimrodt
*Attorney, Agent, or Firm*—Young & Thompson

[57] ABSTRACT

A drawing frame has an electric driving motor (M) and a main shaft (H), which is drivingly connected to several driven rollers (W1–W4, W1'–W4') in the two draw heads (11) of the drawing frame. Between the motor (M) and the main shaft (H) are arranged a belt adjusting gear mechanism (V and HO) and a clutch (K). The transmission ratio of the adjusting gear (V and HO) is automatically gradually reduced from a maximum value to the operating value, so that the main shaft (H) is smoothly accelerated.

Cut-off devices are provided for automatically stopping the frame when a disturbance of any kind occurs. The cut-off devices switch off the electric motor (M), release the clutch (K) and actuate a brake (B) which acts upon the main shaft (H), and also an adjusting member of an adjustable disc (V) of the belt-adjusting gear (V and HO). The brake (B) can be relatively small, as it does not have to decelerate the uncoupled motor (M). The motor (M) and the adjusting gear (V and HO) run on for a short while as a result of their inertia. Within this time, the adjusting gear (V and HO) is automatically set to its maximum transmission ratio without any difficulty, so that it is ready when the drawing frame is restarted.

5 Claims, 3 Drawing Figures

DRAWING FRAME

The invention relates to a drawing frame with a main shaft which is drivingly connected to several driven rollers of at least one draw head and can be driven by an electric motor via belt adjusting gear with a stagelessly adjustable transmission ratio, and with cut-off devices for automatically switching-off the electric motor and for actuating a brake.

Drawing frames of this type are known. The adjusting gear serves to accelerate the main shaft smoothly to its working speed after the electric motor is switched on when the frame is started. This smooth transition is achieved by gradually reducing the transmission ratio of the adjusting gear from a maximum value to the operating value, after the motor is switched on, by means of a control device. The cut-off device stops the frame if any disturbances occur, e.g. interruptions in the belt feed, formation of coils etc. In known drawing frames the brake decelerates, simultaneously, the main shaft and the electric motor, which has a relatively great inertia. At high working speeds especially, the brake must therefore be of really large dimensions, it is naturally desired to stop the main shaft as rapidly as possible. On the other hand, the rapid deceleration of the electric motor makes it difficult to reset the belt adjusting gear to the maximum transmission ratio in preparation for the next time the frame is started, because the belt adjusting gear mechanisms can usually be adjusted only when they are running.

An object of the invention is to provide a drawing frame in which such a large brake is not required and/or in which the difficulties in resetting the adjustable gear are reduced.

From one aspect the invention consists in a drawing frame having a main shaft, a draw head having a plurality of driven rollers drivingly connected to the main shaft, an electric motor (M) for driving the main shaft via an adjustable belt gear including a stagelessly adjustable transmission ratio, a brake, cut-off means for automatically switching-off the electric motor (M) and actuating a brake and a releasable clutch disposed between the adjustable gear and the main shaft, which can be actuated by the cut-off means when the electric motor is switched off and the brake is actuated, the brake being arranged to act on the main shaft and the cut-off means being connected with an adjusting member of the adjustable gear such that it resets the adjustable gear to its maximum or start transmission ratio in preparation for the restart of the draw frame after the brake has been actuated and the clutch released, as long as the switched-off electric motor is still running on as a result of its inertia.

In a preferred embodiment the adjustable gear includes a power take-off pulley and the clutch is disposed between it and the main shaft. The adjustable gear also includes a disc to which the cut-off means are connected.

When the frame is stopped, the clutch between the power take-off pulley of the adjustable gear and the main shaft is thus released and the brake operated. As the brake only has to decelerate the main shaft and the elements driven by the latter, it can be relatively small and decelerate these parts rapidly. The electric motor is switched off when the frame is stopped, but because of its inertia, it runs on for a short while together with the adjustable gear, which is not braked. Within this time, the adjustable gear can be automatically reset to the maximum transmission ratio without any problems, by the adjusting member, which is likewise actuated by the cut-off means.

High working speeds lead to an additional problem with drawing frames which have a double draw head section with several driven rollers in each of the two draw heads. In known drawing frames of this type, the regularity of the work suffers if an attempt is made to increase the working speed from the 500 m/min. which is customary at present, to approximately 700 m/min., for example. It has been found that in known frames the irregularities originate from high working speeds, amongst other things, from distortions and torsional oscillations, which occur because at least some of the equivalent corresponding rollers in the two draw heads are seated on a common shaft and are driven together, generally from one side of the frame. As the rollers themselves cannot be made resistant to torsion in the desired manner, the roller which is further from the drive unit may become distorted in relation to the drive unit.

In order to avoid the irregularities described or to make an increase in the working speed possible, it is proposed that the driven rollers in each of the two draw heads each have a shaft of their own which is independently mounted and carries a driving wheel of its own.

The transmission of driving and torsional forces to a roller by the corresponding roller in the other draw head is thus avoided.

A common drive shaft can be arranged for the corresponding rollers in the two heads for driving the driving wheels of the two rolls. Such a drive shaft can be constructed without any difficulty so as to be resistant to torsion.

An additional important advantage results from the fact that in order to vary the spacings of the rollers in the two draw heads, the rollers corresponding to each other in the draw heads can each be adjusted individually on its own and there is no necessity to align four roller bearings of one common roll shaft exactly with each other.

The invention may be performed in various ways, and one specific embodiment will now be described by way of example with reference to the accompanying drawings, in which.

Figure 1:
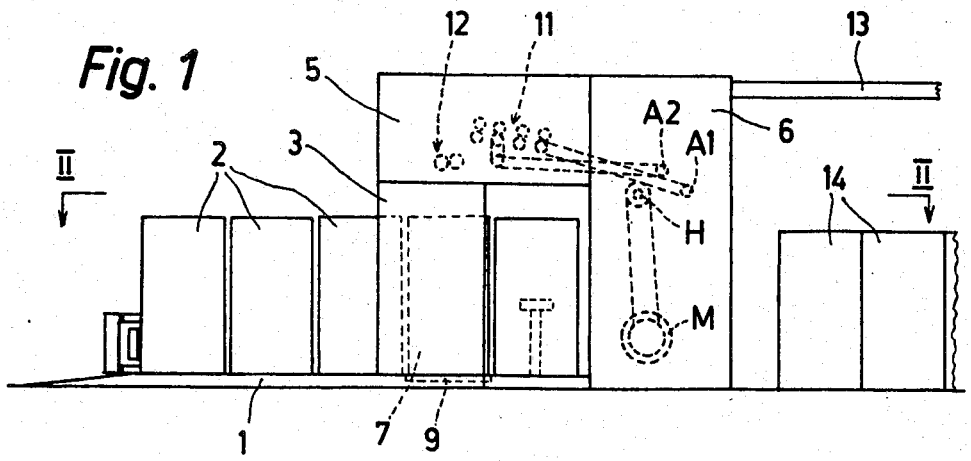
FIG. 1 shows a side view of a drawing frame.

The machine frame of the drawing frame illustrated has a base 1, on which empty cans 2 are fed in in two parallel rows, and a housing with front side walls 3 and 4, a housing top part 5 and a rear housing section 6. Two cans 7 and 8 are illustrated at filling stations at which they stand on can plates 9 and 10 in the base 1. A double draw head 11 is located in the top part 5 of the housing and has devices 12 for filling the cans 7 and 8 which are at the filling stations, as indicated diagrammatically in FIG. 1.

Figure 2:
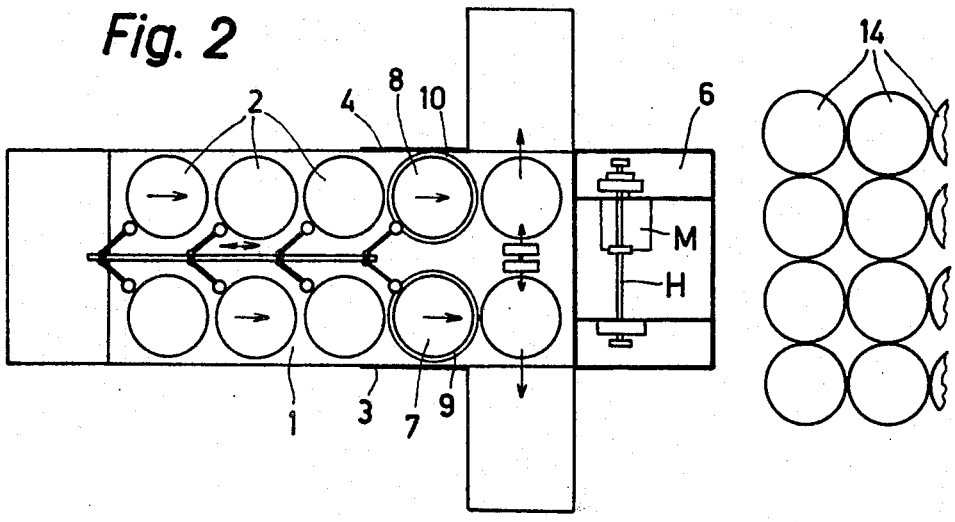
FIG. 2 shows a horizontal section along the line II—II in FIG. 1.

Drive devices control system and suction devices belonging to the frame are located in the rear part 6 of the housing. Of these only one electric motor M, a main shaft H and two drive shafts A1 and A2 are indicated diagrammatically in FIGS. 1 and 2. Furthermore, a run-in table 13 is fixed to the rear section 6. Underneath this are kept the cans 14 which contain the slubbings which are to be drawn.

Figure 3:
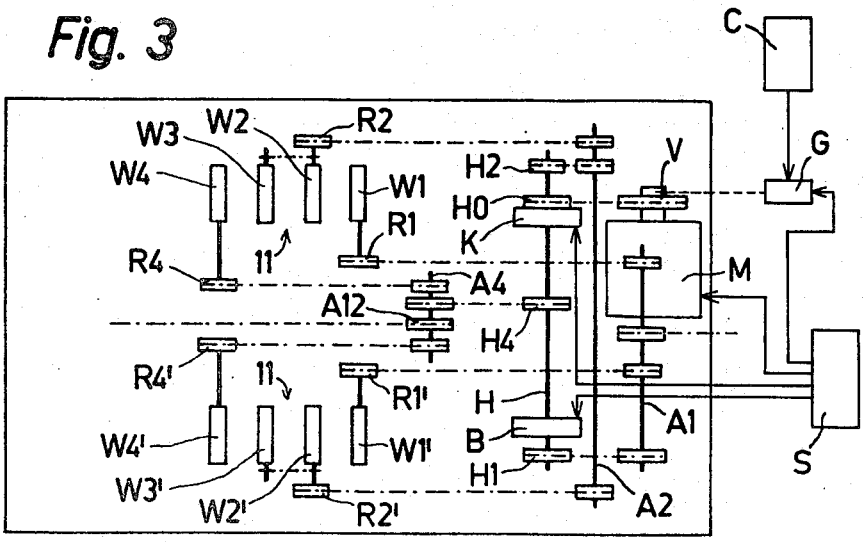
FIG. 3 shows a diagram of the drive unit of the rollers in the two draw heads of the frame, and corresponds more or less to a top plan view (on an enlarged scale).

A diagram of the drive unit of the driven rollers of the two draw heads 11 is shown in FIG. 3. Each draw head contains four driven rollers W1, W2, W3 and W4 or W1', W2', W3' and W4'.

The shafts of the rollers W1 and W1' each carry a driving wheel R1 or R1', which are drivingly connected with sprockets on the drive shaft A1 by means of toothed belts. The drive shaft A1 is driven by a sprocket H1 seated on the main shaft H, via a toothed belt.

The shafts of the rolls W2 and W2' each carry a driving wheel R2 or R2', which are drivingly connected via toothed belts, with sprockets on the drive shaft A2. The drive shaft A2 is driven from a sprocket H2, seated on the main shaft H, via a toothed belt.

The shafts of the rollers W3 and W3' are driven by the shafts of the rollers W2 or W2' via direct geared connections.

The shafts of the rollers W4 and W4' each carry a driving wheel R4 or R4', which are drivingly connected, via toothed belts, with sprockets on a drive shaft A4. The drive shaft A4 is driven from a sprocket H4, which is seated on the main shaft H, via a toothed belt. The drive shaft A4 also carries another sprocket A12, which drives, via a toothed belt, the equipment 12 (FIG. 1) for filling the cans 7 and 8 which are at the filling stations.

The drive of the main shaft H is effected from the motor M via a belt adjusting gear with a stagelessly adjustable transmission ratio, constituted by an adjustable disc V on the motor shaft and a pulley H0 on the main shaft H, which is in communication with the disc V via a wide V belt. An adjusting member G, for example, a pneumatic cylinder, which is automatically actuated, as described hereafter, is provided for adjusting the adjustable disc V.

The adjustable gear V and H0 makes it possible to gradually start the main shaft H, and the elements driven by the latter, when the motor M is switched on. The transmission ratio of the adjustable gear V and H0 is then gradually reduced from a maximum value to the operating value by an automatic control system C which actuates the aforementioned adjusting member G.

The pulley H0 can be rotated on the main shaft H; it is coupled to the main shaft via a releasable electrically operable clutch K. An electrically operable brake B furthermore cooperates with the main shaft H.

Automatic cut-off devices S are provided in conventional manner in order to stop the frame when there are disturbances of various kinds. The cut-off devices S may, for example, be triggered by a sensor (not shown) which responds to an abnormally large or abnormally small distance between the driven rollers W1 or W1' and the idling rollers cooperating therewith. The cut-off devices S then switch off the motor M, release the clutch K, switch on the brake B and then initiate the actuation of the adjusting member G of the adjustable disc V, in order to reset the transmission ratio of the adjustable gear V and H0 to the maximum value.

The following advantages result from the arrangement of the clutch K which has been described. The brake B has to decelerate the main shaft H and the elements driven by the latter, but not the electric motor M with its relatively great inertia. The brake can therefore decelerate the aforementioned parts more rapidly, and it can, moreover, be smaller. After being switched off the electric motor M runs on for a short while because of its inertia; this time allows the adjustable gear V and H0 to be automatically reset to the maximum transmission ratio as this gear can generally only be adjusted when the motor M or the disc V is running.

In the drawing frame described, no common shafts are provided in the draw heads 11 for the rollers corresponding to each other; on the contrary, each of the driven rollers has a shaft of its own, which is independently mounted and carries its own driving wheel. The rollers of the two draw heads are thus driven separately on the two sides of the frame. The advantage of this arrangement is that at high speeds no problems can be caused by torsion inside the rollers and torsional oscillations which might occur if the drive of the rollers of the one draw head were to be effected by means of the corresponding rollers of the other draw head from one side of the frame. Also, the adjustment of the spacing of the rollers inside the two draw heads is easier, because the corresponding rollers in the two draw heads do not have to be adjusted together and four roller bearings do not have to be aligned at any time.

We claim:

1. A drawing frame having a main shaft, a draw head having a plurality of driven rollers drivingly connected to the main shaft, an electric motor (M) for driving the main shaft via an adjustable belt gear, including a stagelessly adjustable transmission ratio, a brake, cut-off means for automatically switching-off of the electric motor (M) and actuating a brake and a releasable clutch disposed between the adjustable gear and the main shaft, which can be actuated by the cut-off means when the electric motor is switched off and the brake is actuated, the brake being arranged to act on the main shaft and the cut-off means being connected with an adjusting member of the adjustable gear such that it resets the adjustable gear to its maximum or start transmission ratio in preparation for the restart of the draw frame after the brake has been actuated and the clutch released, as long as the switched-off electric motor is still running on as a result of its inertia.

2. A drawing frame as claimed in claim 1, where the adjustable gear includes a power take-off pulley and the clutch is disposed between it and the main shaft.

3. A drawing frame as claimed in claim 1, wherein the adjustable gear includes an adjustable disc to which the cut-off means are connected.

4. A drawing frame as claimed in claim 1, having a double draw head section having a plurality of driven rollers in each of the two draw heads, each of the driven rollers being mounted on a separate shaft and at least some of the shafts having respective driving wheels.

5. A drawing frame as claimed in claim 4, wherein drive shafts common to the two draw heads are provided for at least some of the corresponding pairs of rollers in the two draw heads, the drive shafts being in direct driving communication with the two driving wheels of their respective rollers.

* * * * *